United States Patent [19]

Pinson

[11] Patent Number: 4,746,080

[45] Date of Patent: May 24, 1988

[54] METHOD OF WINDING OPTICAL FIBER ON A BOBBIN

[75] Inventor: George T. Pinson, Huntsville, Ala.

[73] Assignee: The Boeing Company, Seattle, Wash.

[21] Appl. No.: 32,243

[22] Filed: Mar. 31, 1987

[51] Int. Cl.[4] ..... B65H 55/04

[52] U.S. Cl. ..... 242/177; 242/18 R; 242/47; 242/159; 242/174; 242/176

[58] Field of Search ..... 242/177, 178, 176, 174, 242/175, 159, 172, 173, 18 R, 47, 43 R, 53

[56] References Cited

U.S. PATENT DOCUMENTS 3,586,563 6/1971 Fukami et al. ..... 242/174 X
4,630,652 12/1986 Dieterich ..... 242/159 X

FOREIGN PATENT DOCUMENTS 128167 7/1984 Japan ..... 242/47

*Primary Examiner*—Stanley N. Gilreath
*Attorney, Agent, or Firm*—Finnegan, Henderson, Farabow, Garrett & Dunner

[57] ABSTRACT

A method of winding optical fiber on a bobbin comprising alternately winding in one direction around the bobbin compact and crossover layers. Each compact layer extends axially of the bobbin from a start end proximate one end of the bobbin to a finish end proximate the other end of the bobbin and includes a plurality of fiber turns in virtual axial contact with each other which define generally parallel grooves in the surface of the compact layer. The turn defining the start and finish ends of each compact layer is aligned with a respective start and finish set-back groove in the surface of the immediately preceding compact layer axially spaced from the respective start and finish ends of the preceding compact layer. Each crossover layer extends axially of the bobbin from the finish end of the preceding compact layer to proximate the start end of the preceding compact layer and includes one or more turns of fiber axially spaced from each other and disposed at an angle to the turns and grooves of the preceding compact layer.

12 Claims, 4 Drawing Sheets

METHOD OF WINDING OPTICAL FIBER ON A BOBBIN

BACKGROUND OF THE INVENTION

1. Field of the Invention

The invention relates to a method of winding optical fiber on a bobbin and, more particularly, to a method of winding optical fiber on a bobbin which permits free streaming of the fiber from the bobbin without clumping or knotting and which minimizes the effect on the optical signal passing through the fiber 2. Description of Related Art A number of weapons and communications systems have been developed or are under development which use an optical fiber for two-way data communication between two or more moving bodies or between a moving body and a fixed station. Examples of such uses include communications links between aircraft, between an aircraft and a ship, and between a projectile, such as a missile or mortar shell, and a control station at its launch site. As an example of the latter use, see applicant's concurrently filed, co-pending U.S. patent application, Ser. No. 32,448, filed Mar. 31, 1987. Use of optical fiber for such communication precludes electromagnetic interference and compromising interception.

Optical fiber, however, has certain disadvantages not present in other forms of communication. Optical fiber is fragile rendering it subject to breakage while a wire communication system is stronger. Aside from breakage, optical fiber communication performance may be degraded by microcracks or microbends in the fiber generated by bending or other stresses imposed on the fiber. Such damage to an optical fiber not only reduces the fiber's long-term durability, but also causes losses in optical signal strength and content.

A typical optical fiber application involves packaging a continuous length of optical fiber inside a vehicle with one end of the fiber being attached to operational devices in the vehicle, attaching the other end of the fiber to a control or communications station at the launch site, launching the vehicle, and conducting two-way communication with the vehicle during its flight.

The problem is to provide a reliable and compact means for packaging the optical fiber in the vehicle which will minimize stresses on the fiber to preclude adverse effects on communication performance and which will permit reliable deployment of the fiber during flight of the vehicle. The use of wire for guidance or control of launched vehicles is known. U.S. Pat. Nos. 3,114,456 to Billiard, 3,156,185 to Hermann et al. and 3,319,781 to Simpson et al. are examples of such uses. The devices of these patents, however, are not directed to use of optical fiber as the communication medium. As noted above, the characteristics of optical fiber present difficulties not involved in use of wire for communication. The patents do teach the use of bobbins on which the wire is wound, but the fragility of optical fiber requires specialized winding on a bobbin that minimizes communication losses as well as permitting free streaming from the vehicle without clumping or knotting.

The subject invention provides a method of winding a continuous length of optical fiber on a bobbin for use in a moving or launched vehicle. The winding method minimizes stresses imposed on the fiber while permitting free streaming of the fiber from the vehicle. Other objects and advantages of the invention will be set forth in part in the description which follows, and in part will be apparent from the description, or may be learned by practice of the invention. The objects and advantages of the invention may be realized and attained by means of the instrumentalities and combinations particularly pointed out in the appended claims.

SUMMARY OF THE INVENTION

In accordance with the purposes of the invention, as embodied and broadly described herein, the method of winding a continuous optical fiber on a bobbin comprises winding a first compact layer of fiber in a first direction around the bobbin from a start end proximate one axial end of the bobbin to a finish end proximate the other axial end of the bobbin, the turns of the fiber in the first compact layer being in virtual axial contact with each other and defining a plurality of generally parallel grooves in the surface of the first compact layer; winding a first crossover layer of fiber in the first direction over the first compact layer from the finish end to proximate the start end thereof, the turns of the fiber in the crossover layer being axially spaced from each other and being disposed at an angle to the turns and grooves in the first compact layer; and thereafter alternately winding a plurality of the compact layers and crossover layers in the first direction around the bobbin, each compact layer axially extending from a start end aligned with a start set-back groove in the preceding compact layer axially spaced from the start end thereof to a finish end aligned with a finish set-back groove in the preceding compact layer axially spaced from the finish end thereof, and each crossover layer axially extending from the finish end to proximate the start end of the preceding compact layer.

Preferrably, a layer of adhesive may be applied to the bobbin surface prior to winding the first layer to secure the first layer to the bobbin. It may also be preferred to have machined grooves in the bobbin surface to secure and align the first layer.

In the preferred embodiment, the start and finish set-back grooves are axially spaced from the respective start and finish ends of each compact layer a distance selected to prevent radially inward pressure imposed by subsequent compact layers from creating an axial gap between the fibers defining the start and finish set-back grooves.

The invention resides in the novel parts, constructions, steps, arrangements, combinations and improvements shown and described. The accompanying drawings, which are incorporated in and constitute a part of this specification, illustrate the presently preferred embodiments of the invention, and, together with the description, serve to explain the principles of the invention.

DESCRIPTION OF THE PREFERRED EMBODIMENT

Reference will now be made to the present preferred embodiment of the invention which is illustrated in the accompanying drawings.

Figure 1:
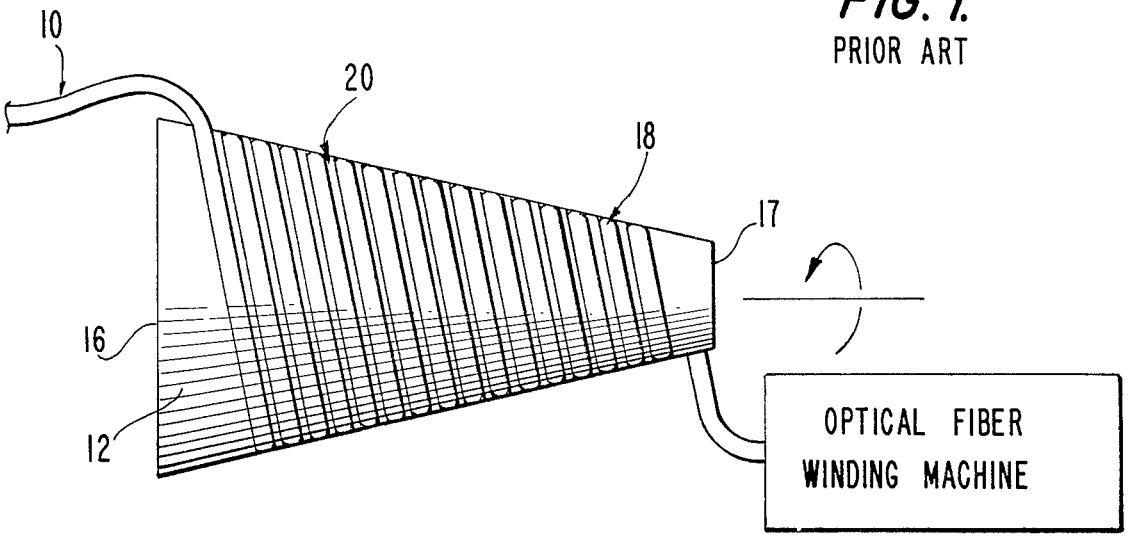
FIG. 1. PRIOR ART
FIG. 1 is a diagrammatic representation of a conventional method of winding a fiber on a bobbin.
Figure 2:
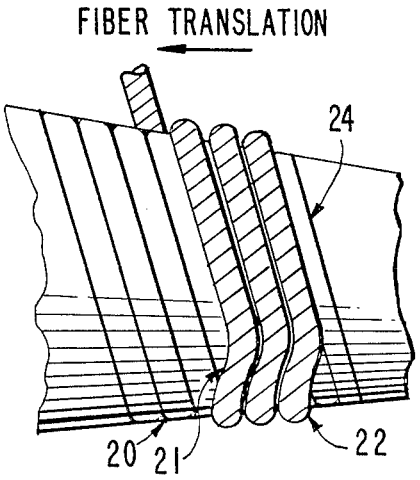
FIG. 2. PRIOR ART
FIG. 2 is a magnified view of the bobbin of FIG. 1 showing the conventional method of winding the second layer of the fiber.
Figure 6:
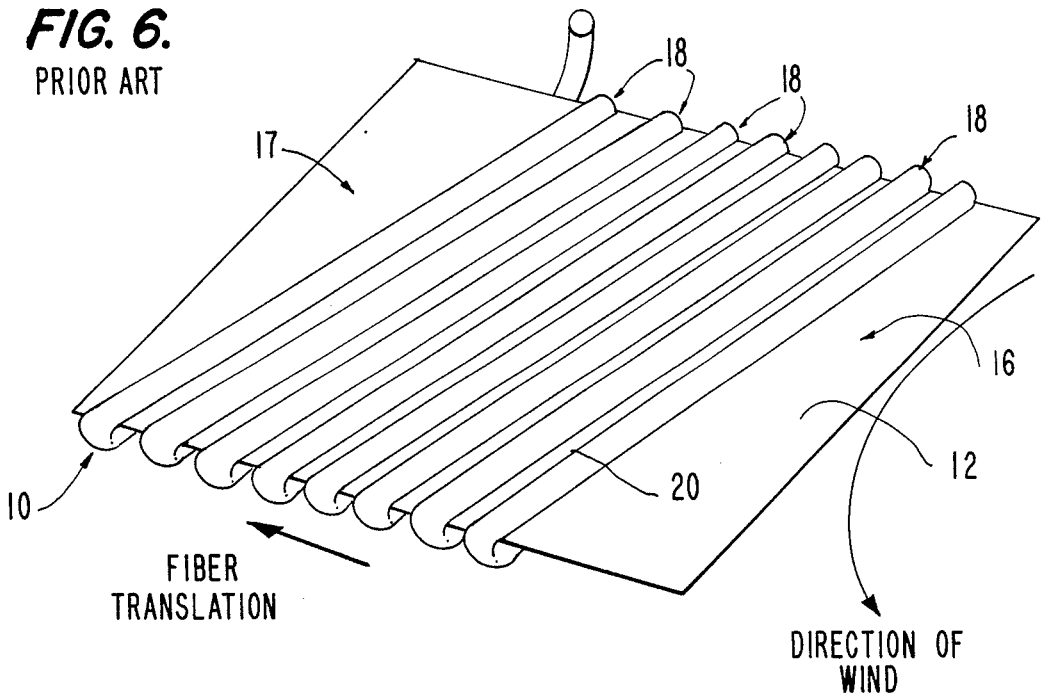
FIG. 6. PRIOR ART
FIG. 6 is an exaggerated depiction of the prior art bobbin of FIG. 1 opened to a flat plane with a first layer of fiber thereon.
Figure 7:
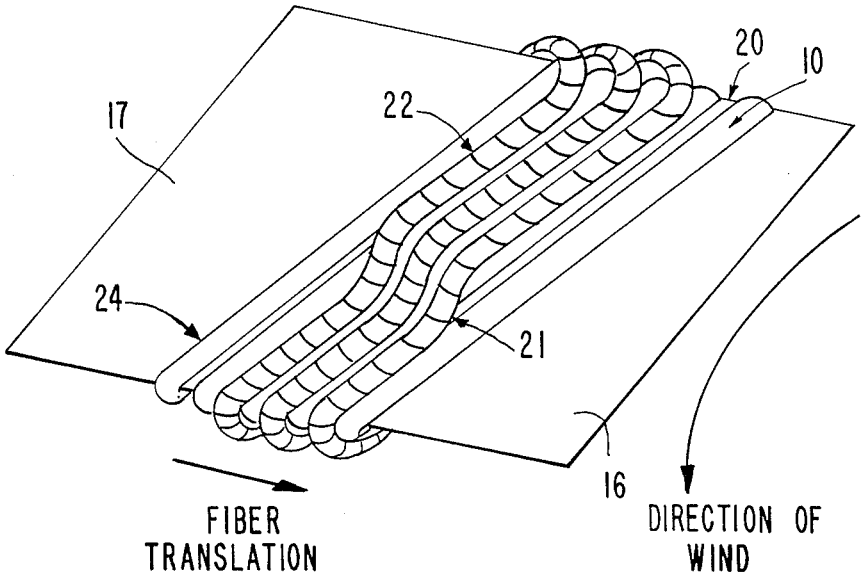
FIG. 7. PRIOR ART
FIG. 7 is an exaggerated depiction of the prior art bobbin of FIG. 1 opened to a flat plane with first and second layers of fiber thereon.

In conventional methods of winding a fiber on a bobbin, axially adjacent turns of fiber are wound on the bobbin surface to form a first layer extending from one axial end of the bobbin to the other. FIGS. 1 and 6 depict application of such a conventional method to winding optical fiber 10 on bobbin 12. Turns 18 of fiber 10 are wound from one axial end 16 to the other axial end 17 with axial spacing 20 between turns 18. Subsequent layers of fiber 10 are begun at the end of the preceding layer with the turns of each layer being disposed in the gaps between the turns of the preceding layer. Such a method of winding if used with optical fiber is highly labor intensive requiring careful quality control to ensure accurate placement of turns in each subsequent layer. Moreover, as depicted in FIGS. 2 and 7, to permit winding of a subsequent layer 22 from the end of the preceding layer 24, the subsequent layer must be wound against the grain of the preceding layer. The turns of the subsequent layer 22 must periodically "cross over" from one groove 20 to the next. Each "cross over" imposes a significant bend 21 in the fiber. To use this method with optical fibers, which are very small in diameter, the equipment used must be extremely accurate, having a tolerance of better than + or −0.0001 inches, which is difficult to achieve in a mechanical system. Failure to accurately place the turns of the subsequent layer 22 in the grooves 20 defined by the preceding layer 24 may result in clumping or knotting during streaming of the fiber from the bobbin.

Use of the conventional method of winding as depicted in FIGS. 1, 2, 6 and 7 with optical fiber also increases the liklihood of degraded optical communication performance. The loss of optical signal transmitted through an optical fiber is a direct function of the amount of microbending or microcracking in the fiber. Where the fiber is wound as depicted in FIGS. 2 and 6, the necessary frequent "cross overs" in each layer substantially increases the degree of microbending. The subject invention overcomes the disadvantages of the conventional winding methods when used with optical fiber.

In accordance with the invention, a method of winding a continuous optical fiber on a bobbin comprises winding a first compact layer of fiber in a first direction around the bobbin from a start end proximate one axial end of the bobbin to a finish end proximate the other axial end of the bobbin, the turns of the fiber in the first compact layer being in virtual axial contact with each other and defining a plurality of generally parallel grooves in the surface of the first compact layer.

Figure 3:
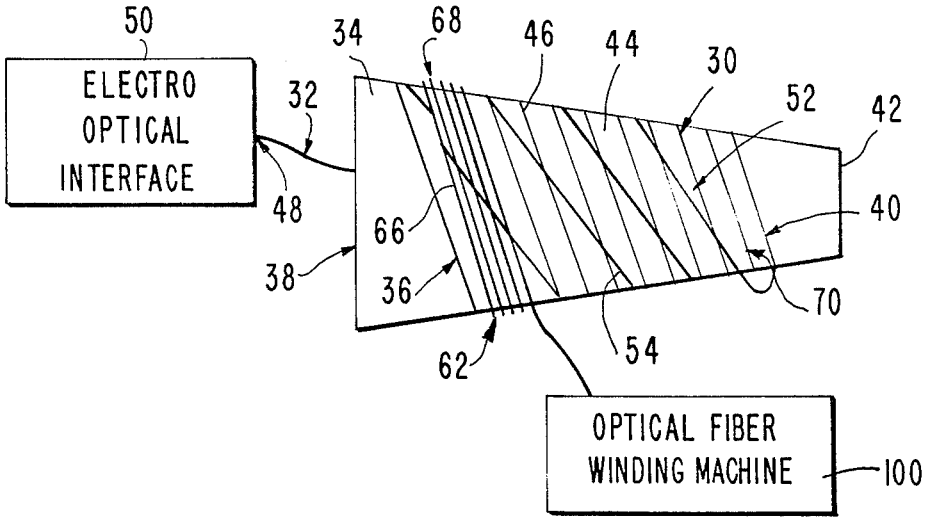
FIG. 3 is a diagrammatic representation of optical fiber wound on a bobbin using the method of the invention.
Figure 8:
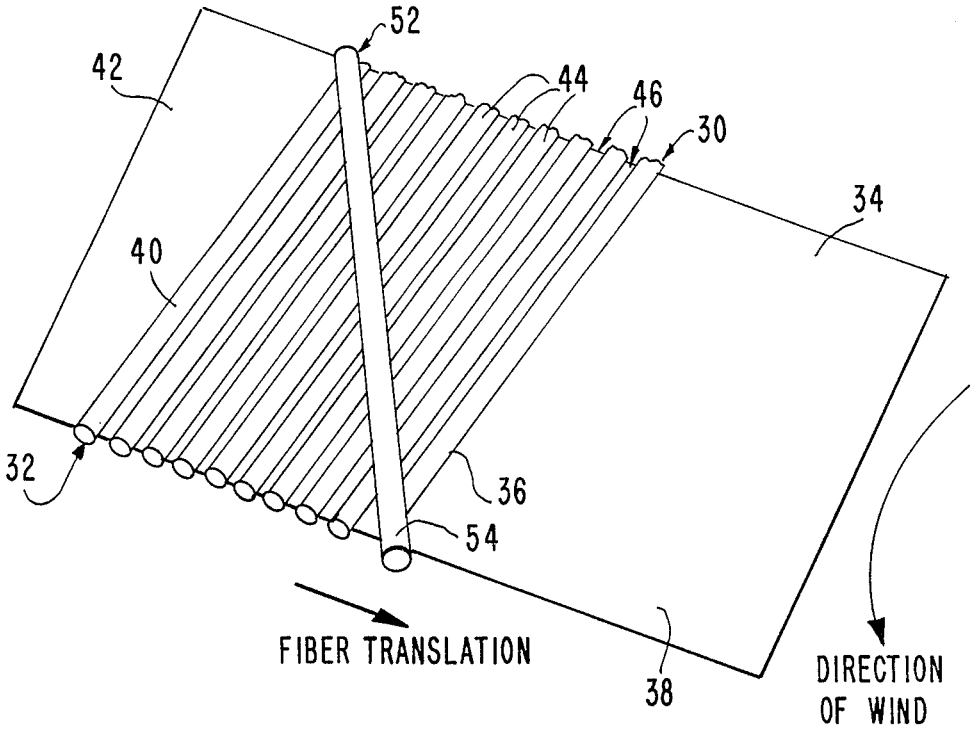
FIG. 8 is an exaggerated depiction of a bobbin open to a flat plane with a compact first layer and a cross-over second layer wound thereon in accordance with the invention.

As embodied herein and depicted in FIGS. 3 and 8, the method of the invention includes winding a first compact layer 30 of fiber 32 in a first direction around bobbin 34 from a start end 36 proximate one axial end 38 of bobbin 34 to a finish end 40 proximate the other axial end 42 of bobbin 34. The turns 44 of fiber 32 in first compact layer 30 are wound in virtual axial contact with each other and define a plurality of generally parallel grooves 46 in the surface of first compact layer 30. By virtual axial contact it is meant that the fiber turns in the compact layer are very close together. But for the need to allow a very small spacing to accommodate thermal expansion, the fiber turns would be axially abutting. The grooves 46 are substantially exaggerated in FIG. 8. For ease of illustration, many winds 44 in first layer 30 are not depicted in FIG. 3.

In a preferred embodiment, the method includes applying a layer of adhesive to the surface of bobbin 34 prior to winding first compact layer 30 to facilitate securing the layer to the bobbin. Any number of known adhesives may be chosen; one such adhesive is Norland Optical Adhesive NOA6B, an ultraviolet curable polymer.

Instead of or in addition of adhesive, it may be preferred to provide a bobbin with machined grooves 31 (FIG. 4) annularly disposed around its surface, to secure and align the first compact layer.

The direction of winding around the axis of bobbin 34 may be either clockwise or counter-clockwise; the chosen direction, however, will remain the same thereafter. While the axial direction of winding depicted in FIG. 3 is from the large diameter end of the truncated-cone shaped bobbin 34 to the small diameter end, beginning winding in the opposite axial direction is preferred. As described below in conjunction with the winding machine, the first layer and all subsequent compact layers preferrably are wound from the small diameter end to the large diameter end, that is in the axial direction opposite to the direction of streaming of the fiber from the bobbin.

As depicted in FIG. 3, one end 48 of fiber 32 may be connected to an electro-optical device 50 during winding so the optical transmission properties of the fiber may be monitored during winding. Use of such a device, which may be, for example, an optical time domain reflectometer, provides a convenient and continuous means for monitoring the quality of the winding operation.

In accordance with the invention, the method includes winding a first crossover layer of fiber in the first direction over the first compact layer from the finish end to proximate the start end thereof, the turns of the fiber in the crossover layer being axially spaced from each other and being disposed at an angle to the turns and grooves in the first compact layer.

In the preferred embodiment depicted in FIGS. 3 and 8, a first crossover layer 52 of fiber 32 is wound in the first direction over first compact layer 30 from finish end 40 to proximate start end 36. The turns 54 of fiber 32 in crossover layer 52 are axially spaced from each other and disposed at an angle to turns 44 and grooves 46 in first compact layer 30. Preferrably, the number of turns 54 in crossover layer 52 is substantially less than the number of turns 44 in first compact layer 30. There will have to be at least one turn 54 in each crossover layer 52 and depending on the axial length of bobbin 34 there may be as many as 10 crossover turns.

Figure 4:
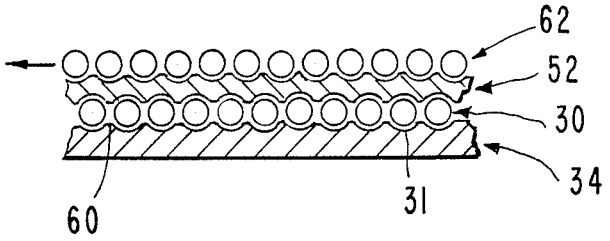
FIG. 4 is a diagrammatic cross-sectional view of the fiber wound on the bobbin using the method depicted in FIG. 3.
Figure 9:
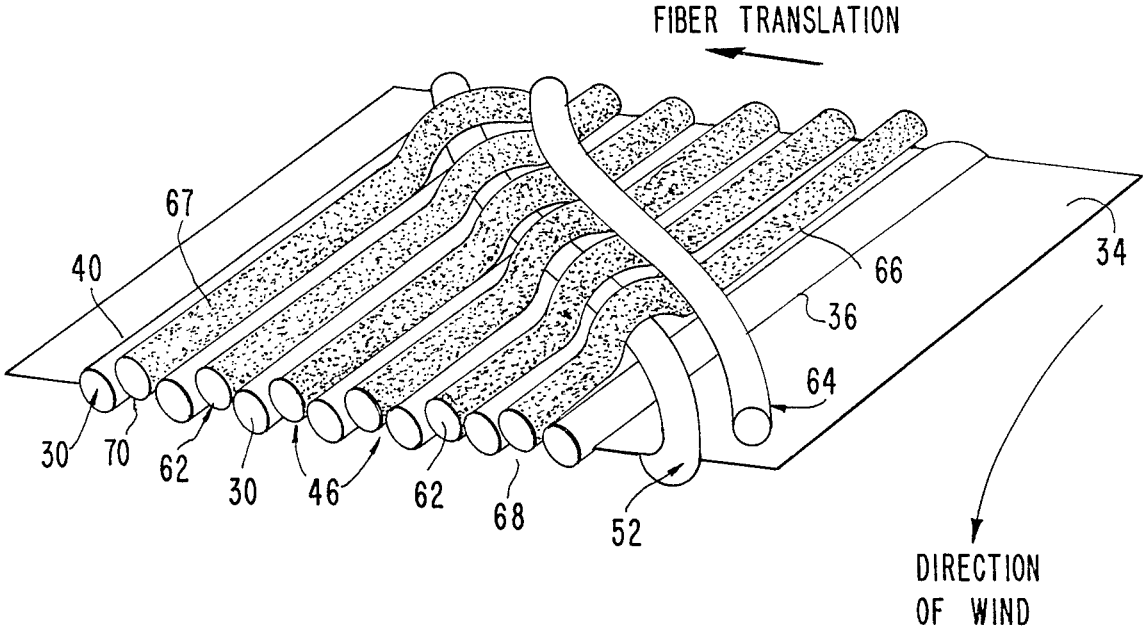
FIG. 9 is an exaggerated depiction of a bobbin open to a flat plane with four layers of fiber wound thereon in accordance with the invention.

For the reasons discussed above, the number of crossover turns 54 in each crossover layer 52 should be minimized to minimize the severity of microbends imposed on the fiber. The effect of the crossover turns is depicted in FIGS. 4 and 9 which are exaggerated for purposes of illustration. Bobbin 34 has a relatively rigid surface 60 on which first compact layer 30 is disposed. The turns of crossover layer 52 are interposed between first compact layer 30 and the next or subsequent compact layer 62. A second cross-over layer 64 is depicted in FIG. 9. Since the turns of each subsequent layer 62 are aligned in the grooves 46 defined by the turns of the preceding layer, the inward radial pressure imposed by succeeding compact layers tends to deform the crossover turns in the grooves. This deformation is microbending which has an adverse effect on optical transmission performance of the fiber. While the number of crossover turns may be the same as in the prior art method (FIG. 2), the method of the invention substantially reduces the severity of the microbends, thereby preserving the optical transmission properties of the fiber. The method of the invention also serves to lock the winds of the preceding compact layer in place. Use of the crossover layers of the invention also permits higher winding speeds.

In accordance with the invention, the method further comprises after winding the first crossover layer alternately winding a plurality of the compact layers and crossover layers in the first direction around the bobbin, each compact layer axially extending from a start end aligned with a start set-back groove in the preceding compact layer axially spaced from the start end thereof to a finish end aligned with a finish set-back groove in the preceding compact layer axially spaced from the finish end thereof, and each crossover layer axially extending from the finish end to proximate the start end of the preceding compact layer.

As depicted in FIGS. 3 and 9, a second compact layer 62 is wound over first crossover layer 52, the winds of layer 62 being disposed in grooves defined by first compact layer 30. Second compact layer 62 axially extends from a start end 66 aligned with a start set-back groove 68 defined in first compact layer 30 axially spaced from start end 36 thereof to a finish end 67 aligned with a finish set-back groove 70 defined in first compact layer 30 axially spaced from finish end 40 thereof After completion of second compact layer 62, another crossover layer 64 is wound from the finish end of the second compact layer to proximate the start end 66 of the second compact layer 62. This process of alternately winding compact and crossover layers continues until the desired length of optical fiber is wound on the bobbin. Each compact layer begins and ends in a set-back groove defined in the preceding compact layer axially spaced from the respective start and finish ends thereof. The result is that each compact layer of fiber has fewer turns than the preceding compact layer.

The set-back at each end of each subsequent compact layer is selected to preclude creation of an axial gap between fibers proximate each end of the preceding compact layer. The turns of each compact layer are aligned with the grooves of the preceding compact layer. The radially inward pressure imposed by subsequent compact layers would tend to force turns of the subsequent compact layer between the turns of the preceding compact layer. By having each subsequent compact layer begin and end with a set-back from the respective beginning and ending of the preceding compact layer, the turns proximate the start and finish ends of the preceding compact layer are unaffected by the inward pressure and serve to resist separation of axially inward turns of fiber defining the set-back grooves. While the set-back for each layer may vary with different bobbins and different fibers, preferrably the set-back of each compact layer is at least two fiber diameters from the start and finish ends thereof.

Figure 5:
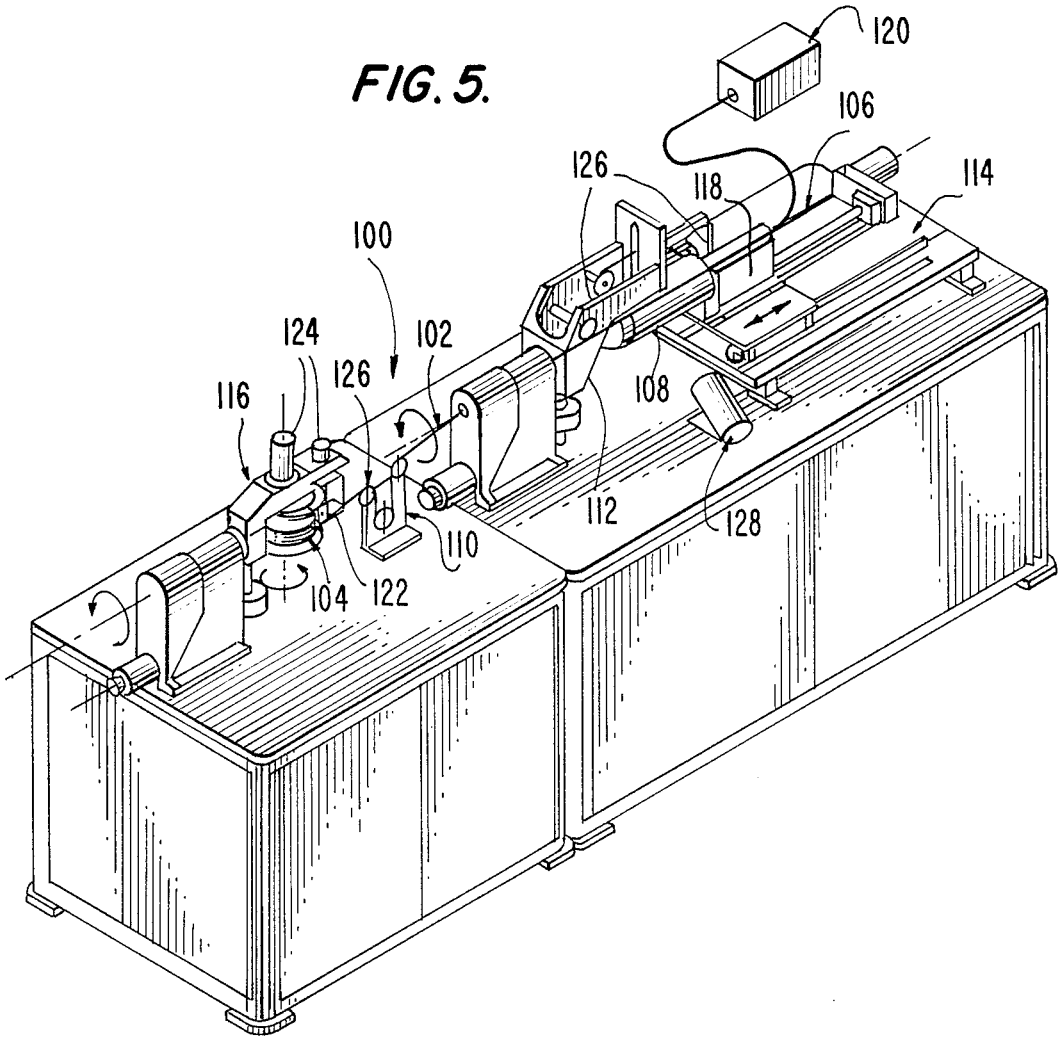
FIG. 5 is a perspective view of a preferred device for winding fiber on a bobbin in accordance with the invention.

While many means for winding optical fiber in accordance with the invention may be used, the presently preferred optical fiber winding machine 100 is depicted in FIG. 5. In winding machine or winder 100, optical fiber 102 is fed from fiber supply reel 104 along deployment axis 106, that is the same axis that the optical fiber is deployed from the bobbin when in use. Optical fiber 102 is guided to bobbin 108 via fiber tension control device 110 to feed twist arm 112 which rotates around bobbin 108. Bobbin 108 is moved along deployment axis 106 by bobbin drive 114 a predetermined distance for every turn of twist arm 112. Fiber supply reel 104 may be rotated around deployment axis 106 by reel twist arm 116 a predetermined amount for every turn of feed twist arm 112.

In winder 100, therefore, fiber 102 is wound on bobbin 108 in reverse of the manner in which fiber 102 streams from the bobbin when in use. The twist imparted to fiber 102 during the winding process using winder 100 is varied depending on the change of torsion in fiber 102 during storage of the wound bobbin and to eliminate torsional stress and twisting of fiber 102 during deployment from bobbin 108. The twist is predetermined in view of the properties of the glass and/or plastic in fiber 102.

Bobbin 108 may or may not be rotated during winding depending on whether a reflectometer is used. Prior to winding one end of fiber 102 is threaded into the inside of bobbin 108, through bobbin support 118, and to optical time domain reflectometer 120. The latter device continuously monitors the optical characteristics of fiber 102 during winding, and if optical attenuation exceeds a predetermined value, the winding operation is stopped and the cause determined. Winder 100 permits rewinding from bobbin 108 to reel 104 over a level winding device 122 and tension control 110 which assures even rewinding. If a defect is identified, the fiber is rewound to reel 104 until the defective portion is located and the defective portion is cut out and the undamaged fiber is spliced.

Tension in fiber 102 during winding is measured by tension sensor 110 and tension control device 124. The latter includes a brake used for precision starting and stopping of reel 104, the reel drive motor and reel clutch. Desired winding tension is small to minimize compressive stress in fiber 102 which increase attentuation of optical signals through the fiber. Small variations in tension imposed generally at points 126 along the fiber path are removed by control of the reel motor and clutch.

Winder 100 also includes sensor 128 disposed to identify undesired gaps between fiber turns on bobbin 108 and inadvertant overwinds of the fiber during winding. Sensor 128 includes means for automatically stopping, rewinding, and restarting the process in response to sensed defects.

The invention provides a method of winding optical fiber on a bobbin for free streaming therefrom which minimizes attentuation of optical signals through the fiber. It will be apparent to those skilled in the art that various modifications and variations could be made to the method of the invention Without departing from the scope or spirit of the invention.

What is claimed is:

1. A method of winding a continuous optical fiber on a bobbin comprising:

winding a first compact layer of said fiber in a first direction around said bobbin from a start end proximate one axial end of said bobbin to a finish end proximate the other axial end of said bobbin, the turns of said fiber in said first compact layer being in virtual axial contact with each other and defining a plurality of generally parallel grooves in the surface of said first compact layer;

winding a first crossover layer of said fiber in said first direction over said first compact layer from the finish end to proximate the start end thereof, said crossover layer including at least one turn of said fiber disposed at an angle to the turns and grooves in said first compact layer; and thereafter alternately winding a plurality of said compact layers and crossover layers in said first direction around said bobbin, each said compact layer axially extending from a start end aligned with a start set-back groove in the preceding compact layer axially spaced from the start end thereof to a finish end aligned with a finish set-back groove in the preceding compact layer axially spaced from the finish end thereof, and each said crossover layer axially extending from the finish end to proximate the start end of the preceding compact layer.

2. The method of claim 1 also including the step of applying a layer of adhesive to said bobbin prior to winding said first compact layer to facilitate securing the winds of said first compact layer to said bobbin.

3. The method of claim 1 also including the step of machining annular grooves in the surface of said bobbin prior to winding said first compact layer to facilitate securing and aligning the winds of said first compact layer to said bobbin.

4. The method of claim 1 wherein winding of said compact and crossover layers is achieved by rotating said bobbin about its axis and selectively axially moving said fiber relative to said bobbin.

5. The method of claim 1 wherein winding of said compact and crossover layers is achieved by feeding said fiber in an annular path around said bobbin and selectively axially moving said bobbin relative to said fiber annular path.

6. The method of claim 1 wherein said bobbin has a truncated-cone shape and said one axial end is the end with the larger diameter.

7. The method of claim 1 wherein said bobbin has a truncated-cone shape and said one axial end is the end with the smaller diameter.

8. The method of claim 1 wherein each said crossover layer includes at least one but not more than ten turns of said fiber.

9. The method of claim 1 wherein the number of turns of fiber in each said crossover layer is substantially less than the number of turns in radially adjacent compact layers.

10. The method of claim 1 wherein the axial distance of the start and finish set-back grooves of each said compact layer from the respective start and finish ends thereof is selected to prevent radially inward pressure of subsequent compact layers from creating an axial gap between the fibers of said compact layer defining said start and finish set-back grooves.

11. The method of claim 10 wherein the start and finish set-back grooves of each said compact layer are axially spaced from respective start and finish ends by a distance of two or more fiber diameters.

12. A bobbin with optical fiber wound thereon, said bobbin comprising a plurality of alternating compact and crossover layers of said fiber wound in one direction around said bobbin, each said compact layer extending axially of said bobbin from a start end proximate one end of said bobbin to a finish end proximate the other end of said bobbin and including a plurality of turns of fiber in virtual axial contact with each other which define a plurality of generally parallel grooves in the surface of the compact layer, the turn defining the start and finish ends of each compact layer being respective aligned with start and finish set-back grooves in the surface of the immediately preceding compact layer, said set back grooves being axially spaced from the respective start and finish ends of said preceding compact layer, and each crossover layer extending axially of the bobbin from proximate the finish end of the preceding compact layer to proximate the start end of the preceding compact layer and including one or more turns of fiber axially spaced from each other and disposed at an angle to the turns and grooves of the preceding compact layer.

* * * * *